US008876933B2

(12) United States Patent
Short et al.

(10) Patent No.: US 8,876,933 B2
(45) Date of Patent: Nov. 4, 2014

(54) CORE DIFFUSER FOR DEOILER/BREATHER

(75) Inventors: Keith E. Short, Rockford, IL (US); Michael R. Blewett, Stillman Valley, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1001 days.

(21) Appl. No.: 12/962,959

(22) Filed: Dec. 8, 2010

(65) Prior Publication Data

US 2012/0144841 A1 Jun. 14, 2012

(51) Int. Cl.
*F01M 13/04* (2006.01)

(52) U.S. Cl.
CPC ..... *F01M 13/04* (2013.01); *F01M 2013/0422* (2013.01)
USPC ..... 55/409; 95/198; 96/272; 60/751; 415/115

(58) Field of Classification Search
CPC .. F01M 13/04; F01M 2013/0422; F01D 5/08; F01D 5/081; F01D 5/082; F01D 5/084; F01D 5/085; F01D 5/087
USPC ..... 60/39.08, 782, 785, 751; 415/115, 157, 415/170.1, 202, 208.2; 55/400, 408, 409; 95/270, 272; 96/197, 198
See application file for complete search history.

(56) References Cited

U.S. PATENT DOCUMENTS

| | | | | |
|---|---|---|---|---|
| 4,541,774 | A * | 9/1985 | Rieck et al. | 415/115 |
| 5,716,423 | A * | 2/1998 | Krul et al. | 55/485 |
| 6,033,450 | A * | 3/2000 | Krul et al. | 55/409 |
| 6,858,056 | B2 * | 2/2005 | Kwan | 55/400 |
| 6,893,478 | B2 * | 5/2005 | Care et al. | 55/406 |
| 7,377,110 | B2 * | 5/2008 | Sheridan et al. | 60/39.08 |
| 7,708,519 | B2 * | 5/2010 | Mignano | 415/157 |
| 7,993,425 | B2 * | 8/2011 | Corattiyil et al. | 55/409 |
| 8,453,463 | B2 * | 6/2013 | Grewal et al. | 60/782 |
| 8,714,905 | B2 * | 5/2014 | Fintescu et al. | 415/1 |
| 2004/0098956 | A1 * | 5/2004 | Care et al. | 55/400 |
| 2005/0217272 | A1 * | 10/2005 | Sheridan et al. | 60/39.08 |
| 2009/0133581 | A1 | 5/2009 | Fang et al. | |
| 2010/0300113 | A1 * | 12/2010 | Grewal et al. | 60/782 |
| 2011/0258977 | A1 * | 10/2011 | Dejaune et al. | 55/409 |
| 2013/0042760 | A1 * | 2/2013 | Short et al. | 95/270 |
| 2013/0319240 | A1 * | 12/2013 | Short et al. | 95/268 |

FOREIGN PATENT DOCUMENTS

| | | |
|---|---|---|
| EP | 1 582 703 A2 | 10/2005 |

OTHER PUBLICATIONS

Extended European Search Report from EP Application Serial No. 11187199.2, filed Oct. 28, 2011.

* cited by examiner

*Primary Examiner* — J. Gregory Pickett
(74) *Attorney, Agent, or Firm* — Kinney & Lange, P.A.

(57) ABSTRACT

A breather assembly for use with a gas turbine engine includes a static housing for accepting a fluidic mixture of substances, a rotatable separator having one or more fluid inlets and arranged about an axis of rotation, an exhaust outlet defined in the housing and positioned coaxially with the rotatable separator to accept fluidic exhaust from the rotatable separator, and a static diffuser supported by the housing at or near the exhaust outlet downstream from the rotatable separator. A portion of the static diffuser extends within the rotatable separator. The static diffuser includes a flow-straightening structure configured to reduce vortex flows in fluid flows passing through the exhaust outlet.

20 Claims, 5 Drawing Sheets

CORE DIFFUSER FOR DEOILER/BREATHER

BACKGROUND

The present invention relates to deoiler or breather assemblies, and more particularly for deoiler or breather assemblies for use with gas turbine engine gearboxes.

Gas turbine engines and other mechanical devices can include gearboxes and/or bearing assemblies that utilize an oil flow for cooling and lubricating purposes. It is often desired to avoid pressuring bearing compartments and gearboxes, but instead to vent such compartments and allow them to "breathe". In such an arrangement, oil can become mixed with vented air, causing oil saturation in that air. It is further desired to reclaim oil present in the vented air. The presence of oil in vented air that leaves an engine is unsightly and aesthetically undesirable. In particular, for gas turbine engines used in commercial airline applications, the visible clouds of oil in exhaust streams may be unpleasant to customers or passengers who prefer such exhaust streams to appear transparent—even if such exhaust streams are harmless and within accepted operating parameters.

In a typical prior art deoiler/breather assembly (the terms "deoiler" and "breather" are used synonymously herein), a fluidic mixture of oil and air in a bearing or gearbox compartment is passed through a rotating separator that draws oil out of the mixture. The oil removed from the mixture can then be returned to a primary lubrication circuit for further use. Remaining air from the mixture can leave the rotating separator through a tube or shaft located along a central axis of rotation and can be exhausted from the engine (and its nacelle) to ambient air. Such prior art deoiler/breather assemblies are able to efficiently retain oil to avoid losing too much oil through the vented air, though some small amount of oil typically remains in the exhaust stream of the remaining air. In a typical gas turbine engine, air in the deoiler/breather assembly is at elevated temperatures generally in the range of approximately 121-177° C. (250-350° F.). At elevated temperatures, oil can exist as vapor (i.e., in a gaseous state). However, condensation of small, dispersed oil droplets can exist in vented exhaust streams under certain circumstances. In particular, when vented air containing oil vapor is cooled by adiabatic expansion (i.e., a decrease in pressure) or by mixing with colder air, the oil vapor can condense into tiny droplets (i.e., liquid state droplets) that can reflect light in the visible spectrum and appear as "white smoke", that is, as a visible cloud of material that can appear to be smoke from a combustion process to an unfamiliar observer.

Prior art solutions to the problem of visible oil in exhaust streams from deoilers/breathers include dispersing such exhaust streams in a fan bypass stream from the engine, which combines the oil-containing exhaust stream with such a large volume of oil-free air that the oil is greatly dispersed and not readily visible. However, this solution requires that an exhaust port for the deoiler/breather to have a particular location in relation to the fan bypass air stream (typically an exhaust port near an aft end of the engine), which is not always feasible for certain engine and nacelle configurations. In the past, efforts have also been made to improve air/oil separation so that less oil is present in exhaust streams from a deoiler/breather. However, even with such efficiency improvements, the separation process is not 100% efficient and some small amount of oil will remain in exhaust streams that may become visible. In addition, some deoiler/breather assemblies have included a cruciform structure on an interior of a rotating exhaust shaft or tube to eliminate a "free" vortex that can lead to oil condensation in the exhaust stream by regulating vortex rotation with the cruciform structure. However, because such cruciform structures rotate with the shaft of the separator, they must be rotationally balanced, which is difficult to accomplish.

Thus, an improved deoiler/breather assembly is desired.

SUMMARY

A breather assembly for use with a gas turbine engine according to the present invention includes a static housing for accepting a fluidic mixture of substances, a rotatable separator having one or more fluid inlets and arranged about an axis of rotation, an exhaust outlet defined in the housing and positioned coaxially with the rotatable separator to accept fluidic exhaust from the rotatable separator, and a static diffuser supported by the housing at or near the exhaust outlet downstream from the rotatable separator. A portion of the static diffuser extends within the rotatable separator. The static diffuser includes a flow-straightening structure configured to reduce vortex flows in fluid flows passing through the exhaust outlet.

DETAILED DESCRIPTION

Figure 1:
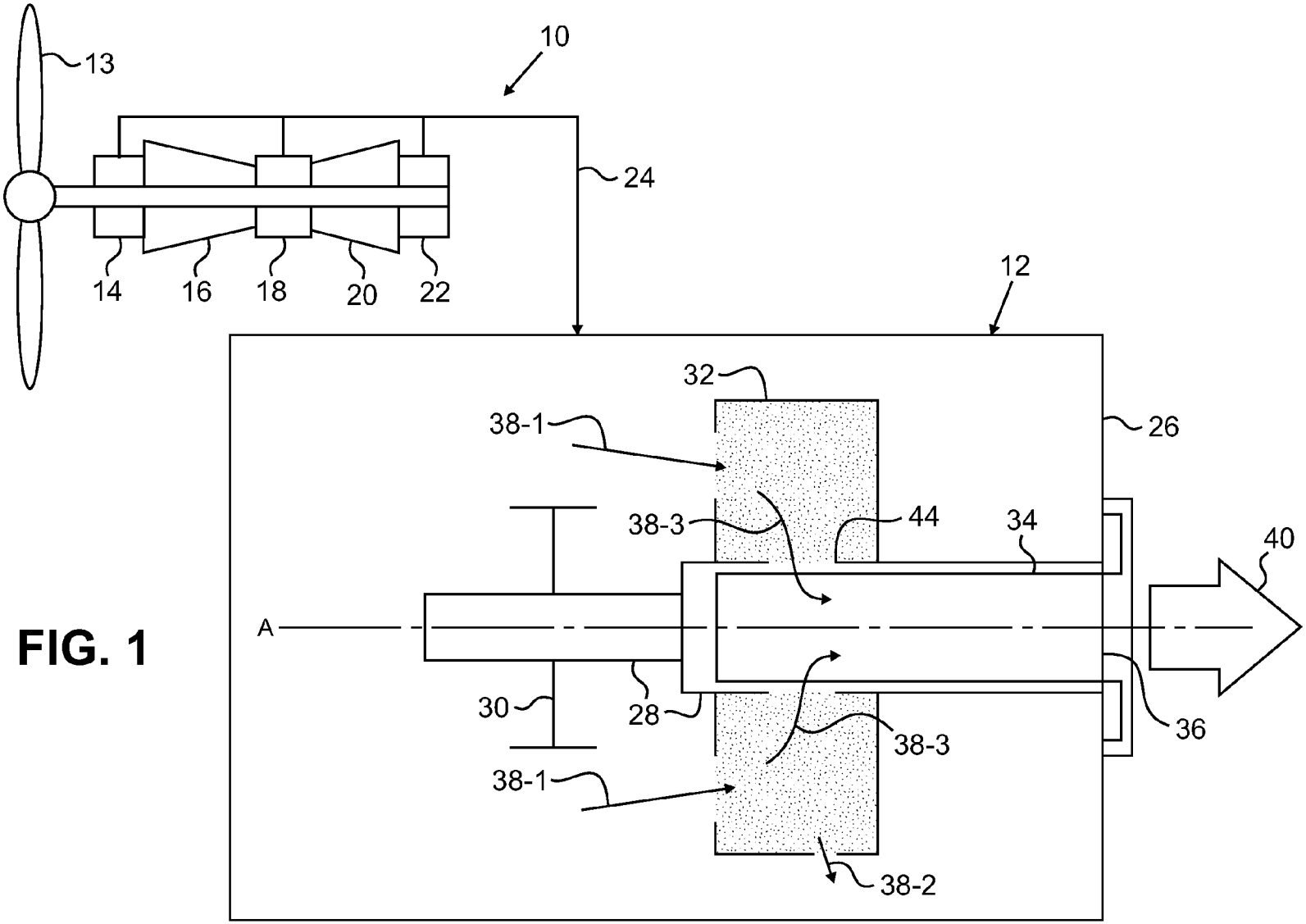
FIG. 1 is a schematic illustration of a gas turbine engine having a breather assembly according to the present invention.

Deoiler or breather assemblies (the terms "deoiler" and "breather" are used synonymously herein) are used in gas turbine engines to separate oil from air within vented lubrication compartments before venting that air in an exhaust stream. However, prior art breather assemblies can produce a visible cloud ("white smoke") in an exhaust stream if oil remaining in the exhaust stream condenses forming tiny dispersed droplets (i.e., liquid state oil droplets) that reflect light in the visible spectrum. Visible materials of any sort in an exhaust stream can be aesthetically undesirable, with a general preference being for exhaust streams to appear transparent. It has been found that fluid entering a shaft or tube to be exhausted from a rotating air/oil separator of a breather assembly tends to have a strong rotational component, and conservation of angular momentum in that fluid can form a vortex at an inner diameter or center of that shaft/tube (e.g., the vortex can be formed generally along an axis of rotation of the separator). Such vortices can be intense, like tornados, with a relatively low pressure inside the vortex relative to pressure elsewhere in the exhaust stream. Rapid cooling of fluid in the vortex due to adiabatic expansion causes flash condensation of oil vapor present in the exhaust stream, which produces tiny dispersed droplets of oil. Exhaust fluid then typically mixes with relatively cold ambient air, which can exacerbate droplet formation. Because of these factors, chilled oil droplets in exhaust streams are slow to evaporate and disperse, making it difficult to avoid the presence of visible clouds of oil droplets.

In general, the present invention provides a static (i.e., non-rotating) core diffuser structure that can extend in a cantilevered manner into a rotating portion of an air/oil separator of a breather assembly. The core diffuser can help redirect and straighten fluidic exhaust flows in order to convert rotational kinetic energy into axially oriented kinetic energy to help reduce vortex formation and adiabatic expansion in exhaust flows. This, in turn, helps reduce condensation of oil vapor that may be present in the exhaust flows, which helps such exhaust flows maintain a transparent appearance without visible clouds of material. In some embodiments, the core diffuser can be configured with a generally cylindrical support tube attached to a stationary housing of the breather assembly, a plurality of plates attached to the support tube that form a plurality of stages for redirecting fluid flow, and an optional flow straightener secured at a downstream end of the support tube. In other embodiments, the core diffuser can include outer diameter flow guides and a central cruciform flow guide of varying sizes rather than a plurality of plates. The present invention thus provides for a reduction of visible material in exhaust streams, while providing a breather assembly that is relatively simple to manufacture and install in a variety of settings compared to prior art designs. Those of ordinary skill in the art will recognize additional features and benefits of the present invention in view of the accompanying figures and the description that follows.

FIG. 1 is a schematic illustration of a gas turbine engine 10 having a breather assembly 12. As illustrated, the gas turbine engine 10 includes a fan section 13, a low pressure compressor (LPC) section 14, a high pressure compressor (HPC) section 16, a combustor section 18, a high pressure turbine (HPT) section 20, and a low pressure turbine (LPT) section 22. Any or the engine sections, such as the LPC section 14, HPC section 16, combustor section 18, HPT section 20 and LPT section 22, can include bearing chambers or other compartments (not specifically shown) that form part of a lubrication circuit that uses oil or other fluids in a conventional and well-known manner. In gas turbine engine 10, bearing chambers are vented and allowed to "breathe" (i.e., communicate with ambient air) to avoid pressurizing those chambers. Fluid vented from various locations in the engine 10 can be directed through suitable passages 24 to the breather assembly 12, which can optionally be integrated with an accessory gearbox that provides a power input. It should be noted that the particular configuration of the gas turbine engine 10 of FIG. 1 is shown merely by way of example and not limitation. A variety of gas turbine engine configurations are possible, some of which may include components not specifically shown in the simplified schematic representation in FIG. 1. Moreover, because the basic operation of gas turbine engines is well known, further explanation here is unnecessary.

The breather assembly 12 includes a housing 26, a shaft 28, an input gear 30, an air/oil separator 32, a core diffuser 34, and an outlet 36. The housing 26 can be stationary, that is, rotationally fixed relative to mounting location in the engine 10. The term "stationary" is used herein to describe rotationally fixed components that may be present in an engine of a movable vehicle. The shaft 28 is rotatable, and defines an axis of rotation A. In the illustrated embodiment, the shaft 28 includes two sections of different diameter, with at least one of those sections being hollow. The input gear 30 is fixed to the shaft 28 for co-rotation, and can accept rotational input power from suitable mating gearing (not shown), such as an accessory gearbox drive shaft powered by the gas turbine engine 10. The air/oil separator 32 is secured to the shaft 28, and rotates with the shaft 28 when rotational power is supplied by the input gear 30. In one embodiment, the separator 32 can include a conventional metallic foam material or other structure that accepts a fluidic mixture 38-1 of air and oil delivered from the passages 24. The incoming fluidic mixture 38-1 is generally at an elevated temperature (e.g., approximately 121-177° C. (250-350° F.)), and typically contains air saturated with oil vapor as well as finely dispersed oil droplets. The separator 32 helps remove oil droplets from air, returning the removed liquid oil 38-2 to the housing 26 through generally radial outward outlets and passing remaining fluid 38-3 radially inward to the shaft 28. The removed oil 38-2 can be collected in the housing 26 for recirculation in the engine 10 in a conventional manner. The remaining fluid 38-3 is mostly air with trace amounts of oil predominantly in a vapor state. The shaft 28 is configured with a hollow section that defines a fluid passage connecting the separator 32 and the outlet 36. From the shaft 28, remaining fluid 38-3 from which the oil 38-2 has been removed is exhausted (i.e., vented) through the outlet 36 and out of the engine 10 in an exhaust stream 40. As shown in FIG. 1, the outlet 36 is aligned with and centered about the axis A.

The core diffuser 34 extends at least partially into the shaft 28, and is secured in a rotationally fixed manner to the housing 26 at or near the outlet 36. In this way, the core diffuser 34 extends in a cantilevered configuration along the axis A into the shaft 28. The core diffuser 34 influences flow of the fluid 38-3 through the shaft 28 and the outlet 36 to reduce a risk of oil vapor condensation in the exhaust stream 40 by helping to straighten fluid flow and reduce vortex generation. In particular, the pressure of fluid 38-3 in downstream portions of the core diffuser 34 and in the exhaust stream 40 can be substantially equal at radially inward and radially outward locations relative to the axis A, thereby avoiding a low pressure core associated with vortices. The configuration and operation of embodiments of the core diffuser 34 are explained further below.

Figure 2:
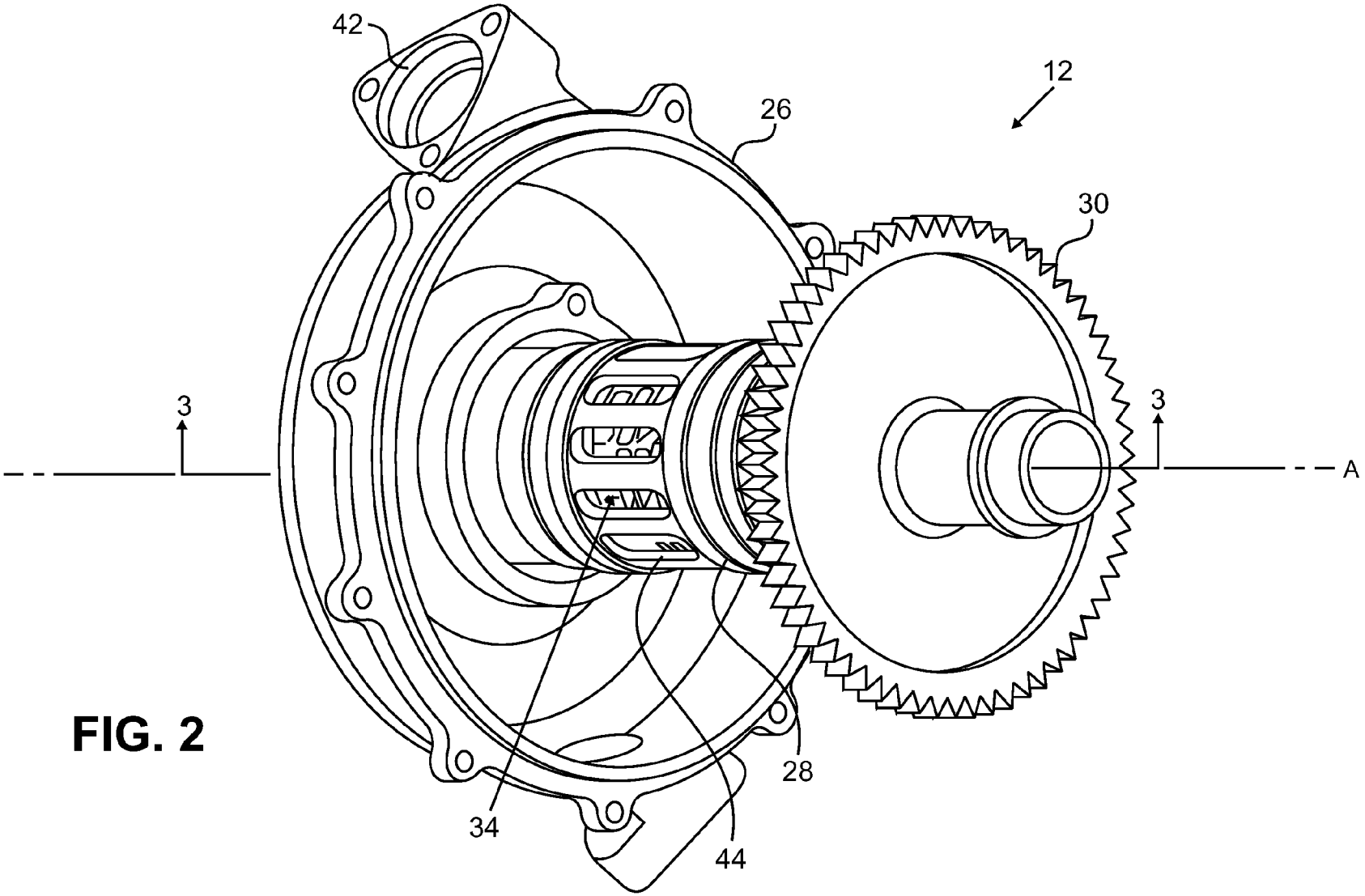
FIG. 2 is a perspective view of a portion of one embodiment of the breather assembly, shown without a rotating separator for illustrative purposes only to better reveal other components of the assembly.
Figure 3:
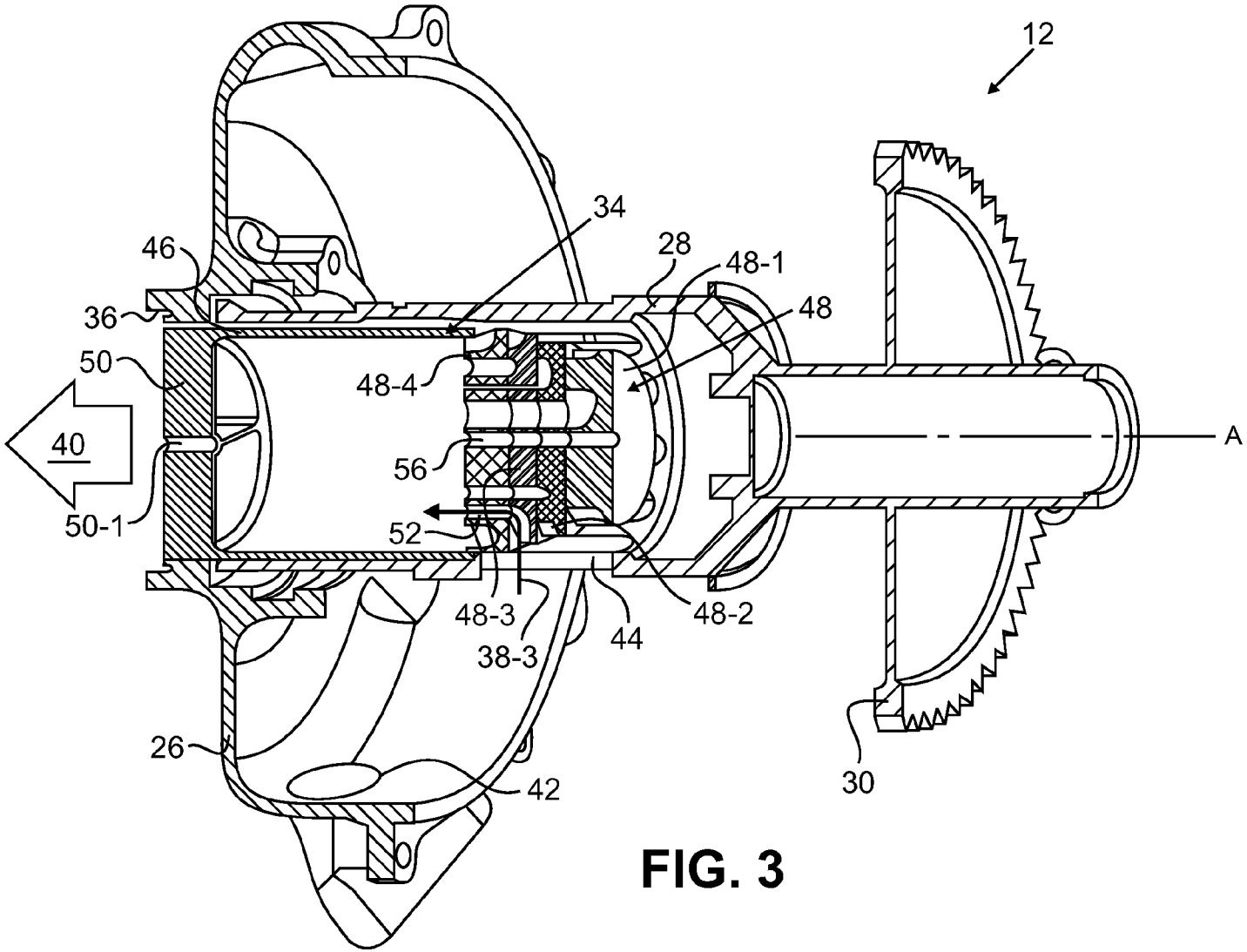
FIG. 3 is a cross-sectional view of the portion of the breather assembly of FIG. 2, taken along line 3-3 of FIG. 2, shown without the rotating separator for illustrative purposes.

FIG. 2 is a perspective view of a portion of one embodiment of the breather assembly 12, and FIG. 3 is a cross-sectional view of the portion of the breather assembly 12 taken along line 3-3 of FIG. 2. For simplicity, the rotating separator 32 mounted on the shaft 28 is not shown in FIGS. 2 and 3. The assembly 12 includes a housing 26 that is stationary and has a plurality of inlet ports 42 to accept fluid 38 from passages 24 (see FIG. 1). In the illustrated embodiment, the inlet ports 42 have a generally tangential orientation relative to the axis A, such that the fluid 38 passing out of the inlet ports 42 tends to rotate circumferentially within the housing 26. The shaft 28 can rotate, and can be supported relative to the housing 26 by suitable bearings (not shown for simplicity). The fluid mixture 38-1 in the housing 26 can pass to the separator 32 (not shown in FIGS. 2 and 3 for simplicity, but see FIG. 1), and the remaining fluid 38-3 from which the liquid oil 38-2 has been removed can pass radially inward through openings 44 in the shaft 28. In the illustrated embodiment, a plurality of slot-shaped and circumferentially spaced openings 44 are provided through a wall of the shaft 28. Other shapes and arrangements of the openings 44 are possible in further embodiments, and the number of openings 44 can vary as desired for particular applications. The fluid 38-3 that enters an interior of the shaft 28 confronts the core diffuser 34.

The core diffuser 34 of the illustrated embodiment includes a substantially cylindrical support tube 46, a flow straightening structure 48, and an optional flow guide 50. The core diffuser 34 can be stationary, that is, rotationally fixed relative to the housing 26. The support tube 46 is fixedly secured to the housing 26 at or near the outlet 36, and extends in a cantilevered configuration along the axis A inside of the shaft 28. A labyrinth-type seal can be created between the housing 26 and the shaft 28 (with a gap between the housing 26 and the shaft 28), which can also create an air curtain seal between the shaft 28 and the support tube 46 to help ensure that the oil wetted fluid 38-1 does not bypass the separator 32 entirely and escape via the exhaust stream 40. In further embodiments, optional circumferential openings (not shown) can be provided in the support tube 46 to allow radially inward fluid flow into the support tube 46.

The flow guide 50 is fixedly secured to the support tube 46 at or near a downstream end of the support tube 46, which is located at the outlet 36. In the illustrated embodiment, the flow guide 50 has a cruciform shape, though other configurations are possible in alternative embodiments. A central opening 50-1 can be formed through the flow guide 50 along the axis A. The flow guide 50 helps maintain a relative straight flow of the remaining fluid 38-3 and discourage circumferential rotation of that fluid 38-3 when leaving the breather assembly 12 in the exhaust stream 40.

The flow straightening structure 48 can be secured to the support tube 46 at or near an upstream end of the support tube 46. The flow straightening structure 48 is static, that is, rotationally fixed relative to the support tube 46 and the optional flow guide 50, and in turn relative to the housing 26. In the illustrated embodiment, the flow straightening structure 48 is axially aligned with the openings 44 in the shaft 28, though other arrangements are possible in alternative embodiments. Furthermore, in the illustrated embodiment the flow straightening structure 48 includes four diffuser stage plates 48-1, 48-2, 48-3 and 48-4. A larger or smaller number of discrete stages can be provided in further embodiments, as desired for particular applications. In the illustrated embodiment, a diameter of each sequential diffuser stage plate 48-1, 48-2, 48-3 and 48-4 is sequentially larger in the downstream direction, such that the diffuser stage plate 48-1 furthest upstream has the smallest diameter and the diffuser stage plate 48-4 furthest downstream has the largest diameter. The diffuser stage plates 48-1, 48-2, 48-3 and 48-4 can be separate components secured together and to the support tube 46 by brazing or other suitable attachment methods. Alternatively, the flow straightening structure 48 can be formed as a monolithic structure that integrally defines different stages. The flow straightening structure 48 and the support tube can be made of a metallic material, such as aluminum, and preferably are made of a material having a coefficient of thermal expansion that is similar or identical to that of a material of the housing 26.

Figure 4:
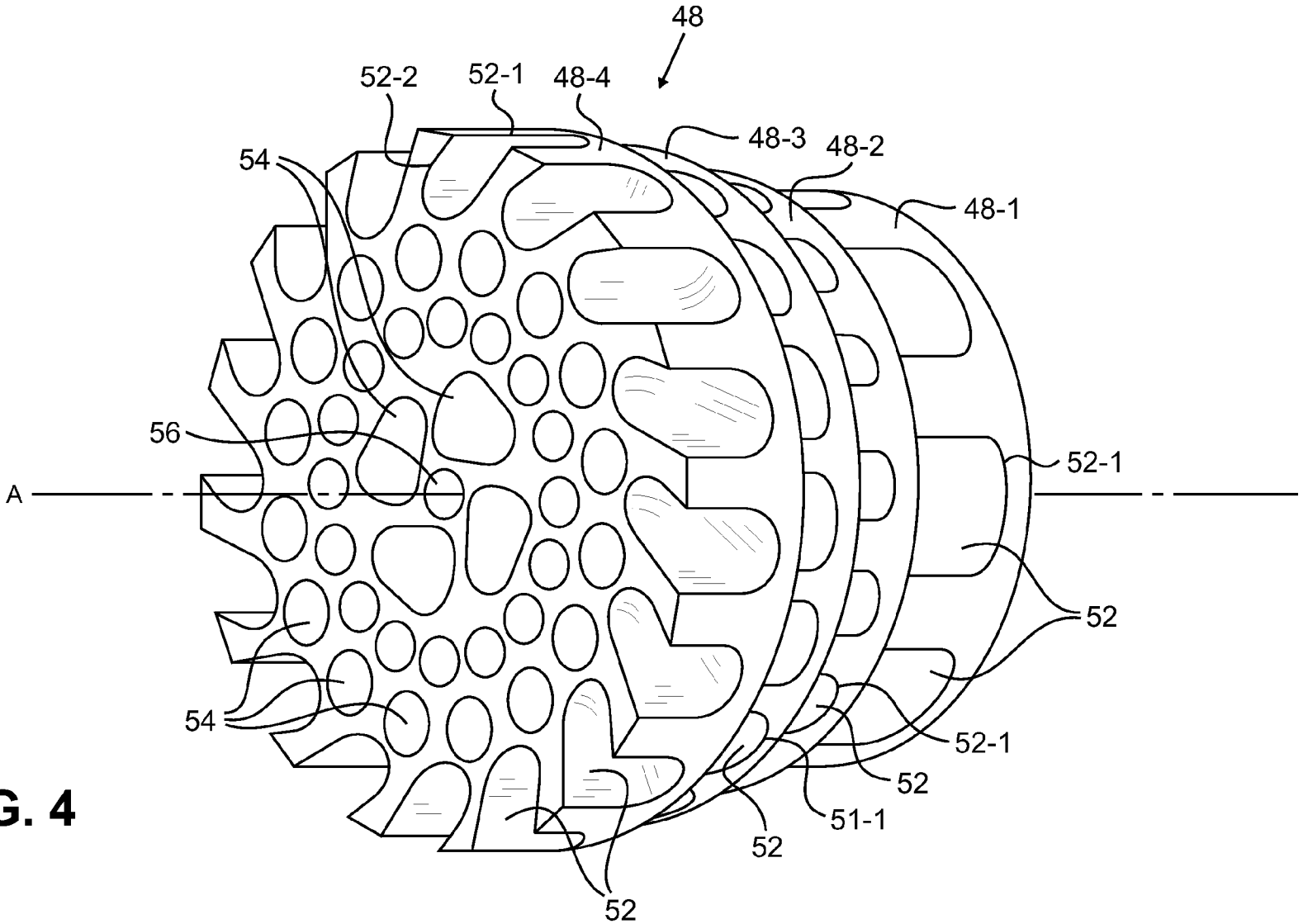
FIG. 4 is a perspective view of a flow straightening structure of the embodiment of the breather static diffuser assembly of FIGS. 2 and 3, shown in isolation.

FIG. 4 is a perspective view of the flow straightening structure 48 shown in isolation. Each diffuser stage plate 48-1, 48-2, 48-3 and 48-4 defines a plurality of flow straightening passages 52, each configured to redirect flow of the fluid 38-3 from a generally radial direction to a generally axial direction. As the fluid 38-3 passes through the passages 52 of the flow straightening structure 48, rotational momentum of the fluid 38-3 (circumferentially relative to the axis A) is converted into axial movement substantially parallel to the axis A to reduce vortex formation in the fluid 38-3. The flow straightening passages 52 each define an inlet 52-1 at a perimeter (or circumference) of the respective diffuser stage plate 48-1, 48-2, 48-3 and 48-4 and an outlet 52-2 at a downstream face and radially inward portion of the respective diffuser stage plate 48-1, 48-2, 48-3 and 48-4. The diffuser stage plates 48-2, 48-3 and 48-4 also can each define a plurality of pass-through openings 54 aligned with the outlets 52-2 of the flow straightening passages 52 of an adjacent one of the diffuser stage plates 48-1, 48-2, or 48-3 located immediately upstream. In this way, fluid 38-3 passing through a flow straightening passage 52 of an upstream diffuser stage plate can pass through one or more downstream diffuser stage plates in a substantially axial direction. The outlets 52-2 of each respective diffuser stage plate 48-1, 48-2, 48-3 and 48-4 can be at different radial locations, such that the pass-through openings 54 do not interfere or intersect with one another. For instance, the pass-through openings 54 that accept fluid flow from the passages 52 of the diffuser stage plate 48-1 can be arranged the most radially inward and the other openings 54 for downstream diffuser stage plates 48-2, or 48-3 arranged sequentially radially outward. Additionally, an auxiliary pass-though opening 56 can be provided that is aligned coaxially with the axis A at a center of all of the diffuser stage plates 48-1, 48-2, 48-3 and 48-4. Cross-sectional areas of the flow straightening passages 52 and the corresponding pass-through openings 54 for each diffuser stage plate 48-1, 48-2, 48-3 and 48-4 can be selected to provide for relatively equal velocities and pressures in the fluid 38-3 across all radial locations in the support tube 46 and in the exhaust stream 40, to help reduce a risk of generating a vortex or otherwise condensing oil vapor.

Figure 6A:
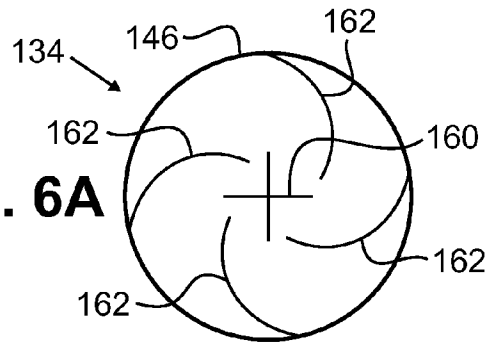
FIGS. 6A-6C are cross-sectional views of the breather assembly of FIG. 5, taken along lines A-A, B-B and C-C, respectively.
Figure 6B:
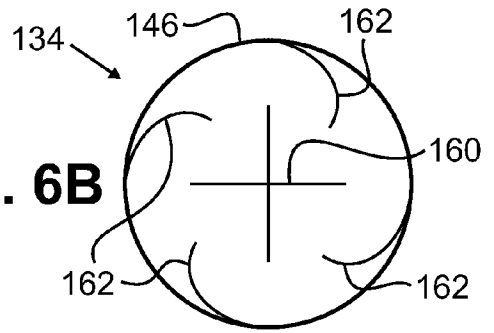
Figure 6C:
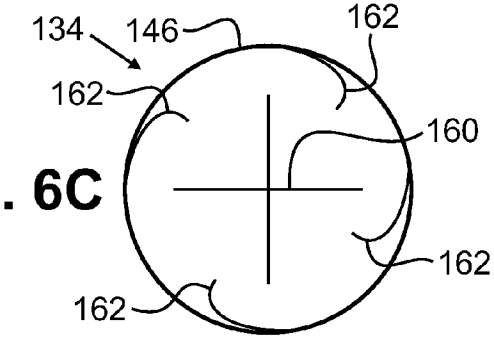
Figure 5:
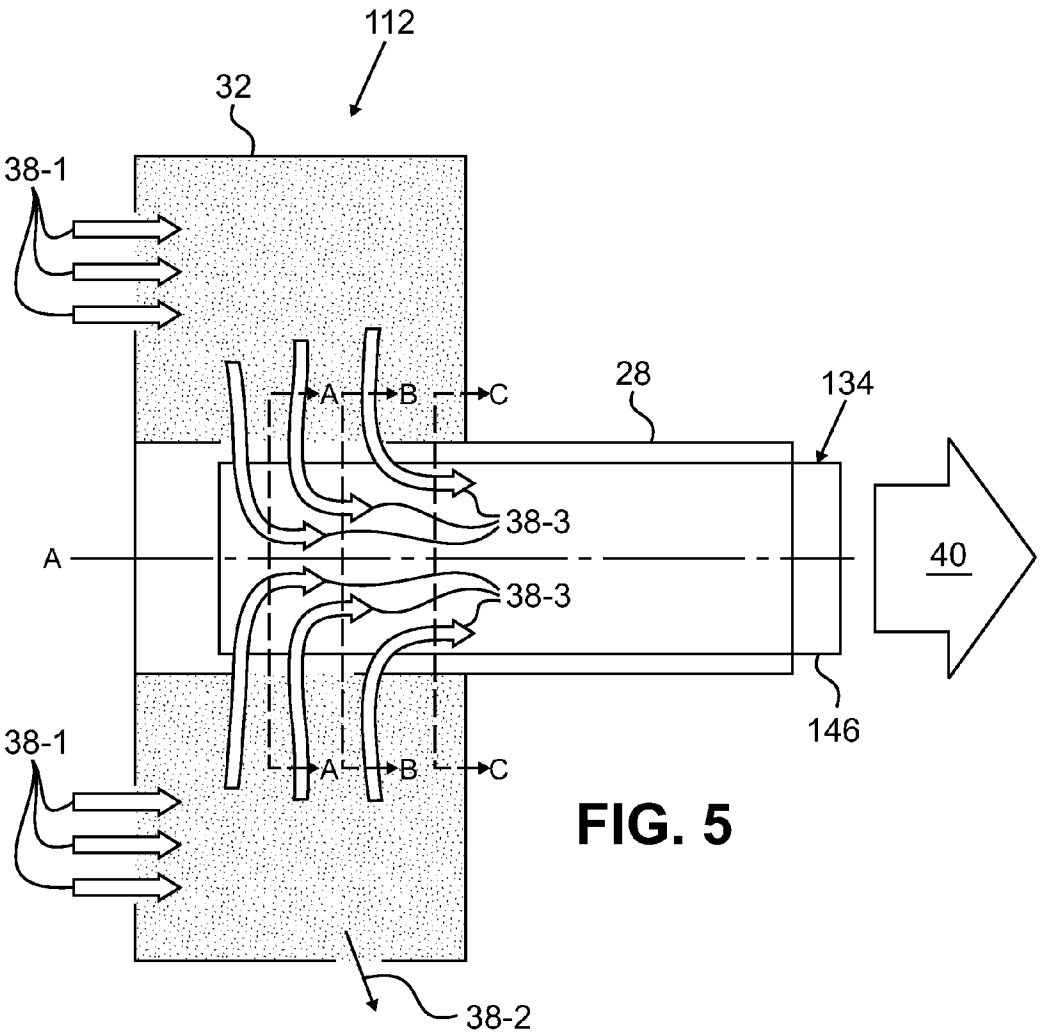
FIG. 5 is a schematic illustration of a portion of another embodiment of a breather assembly according to the present invention.

FIG. 5 is a schematic illustration of a portion of another embodiment of a breather assembly 112, and FIGS. 6A-6C are cross-sectional views of the breather assembly 112 taken along lines A-A, B-B and C-C, respectively. In general, the breather assembly 112 is configured and operates in a similar manner to the breather assembly 12 described above. However, a core diffuser 134 of the breather 112 has a different configuration used to achieve the substantially the same results as the core diffuser 34. Significantly, the core diffuser 134 is static (i.e., non-rotating), and can be secured to the housing 26 (not shown in FIG. 5, but see FIG. 1). As shown in FIGS. 5-6C, the core diffuser 134 can include a support tube that carries a central cruciform flow guide 160 and a plurality (e.g., four) outer diameter flow guides 162. The cruciform flow guide 160 can be secured at or near an upstream end of the support tube 146 in a cantilevered configuration, and the outer diameter flow guides 162 can be secured along an axial length of the tube 146. The outer diameter flow guides 162 can be curved or otherwise aerodynamically shaped and can each be configured to direct flow of the fluid 38-3 radially inward to a given quadrant formed by the cruciform flow guide 160. In that way, circumferential rotation of the fluid 38-3 can be arrested by the core diffuser 134, with rotational momentum in the fluid 38-3 converted to axial momentum. As illustrated in FIGS. 6A-6C, cross-sectional sizes of the cruciform flow guide 160 and the outer diameter flow guides 162 can vary along the axis A. For example, a size of the cruciform flow guide 160 can increase in the downstream direction, such that an upstream portion of the cruciform flow guide 160 can be relatively small (see FIG. 6A) and a downstream portion of the cruciform flow guide 160 can be relatively large (see FIG. 6C). Moreover, sizes of the outer diameter flow guides 162 can each decrease in the downstream direction, such that upstream portions of the outer diameter flow guides 162 can be relatively large (see FIG. 6A) and downstream portions of the outer diameter flow guides 162 can be relatively small (see FIG. 6C).

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For instance, the particular shape and size of passages and other features of a core diffuser according to the present invention can vary as desired for particular applications.

The invention claimed is:

1. A breather assembly for use with a gas turbine engine, the assembly comprising:

a static housing for accepting a fluidic mixture of substances;

a rotatable separator having one or more fluid inlets and arranged about an axis of rotation;

an exhaust outlet defined in the housing and positioned coaxially with the rotatable separator, wherein the exhaust outlet accepts fluidic exhaust from the rotatable separator; and a static diffuser supported by the housing at or near the exhaust outlet downstream from the rotatable separator, wherein a portion of the static diffuser extends within the rotatable separator, the static diffuser including a flow-straightening structure configured to reduce vortex flows in fluid flows passing through the exhaust outlet.

2. The assembly of claim 1, wherein the static diffuser is supported by the static housing in a cantilevered configuration.

3. The assembly of claim 1, wherein the static diffuser comprises:

a substantially cylindrical support tube; and a plurality of diffuser stage plates supported by the support tube, each diffuser stage plate defining a plurality of flow straightening passages.

4. The assembly of claim 3, wherein the flow straightening passages are each configured to redirect fluid flow from a generally radial direction to a generally axial direction.

5. The assembly of claim 3, wherein the flow straightening passages each define an inlet at a circumference of the respective diffuser stage plate and an outlet at a radially inward portion of the respective diffuser stage plate.

6. The assembly of claim 5, wherein at least one of the diffuser stage plates defines a plurality of pass-through openings aligned with the outlets of the flow straightening passages of an adjacent one of the diffuser stage plates located immediately upstream.

7. The assembly of claim 3, wherein the static diffuser further comprises:

a cruciform flow guide at a downstream end of the support tube.

8. The assembly of claim 3 and further comprising:

a separator shaft secured to the rotatable separator and having one or more radial openings, wherein the support tube is positioned coaxially with and at least partially within the separator shaft; and one or more inlets defined in the housing for accepting a fluidic mixture of oil and air, wherein at least one of the one or more inlets has a generally tangential orientation to impart circumferential rotational motion to the fluidic mixture of oil and air entering the housing.

9. The assembly of claim 3, wherein a diameter of each of the diffuser stage plates is sequentially larger in the downstream direction.

10. The assembly of claim 3, wherein the flow straightening passages each define an outlet, and wherein the outlets of each respective diffuser stage plate are at a different radial location.

11. A method for reducing adiabatic condensation of oil in gas turbine engine exhaust streams containing an oil and air mixture, the method comprising:

directing a fluid to a rotating separator assembly;

separating oil from the fluid within the rotating separator assembly to produce a remaining portion of the fluid;

directing the remaining portion of the fluid radially inward from the rotating separator assembly to a static diffuser assembly; and converting rotational momentum of the remaining portion of the fluid into axial movement with the static diffuser assembly to reduce vortex formation in the fluid.

12. The method of claim 11, wherein step of the converting rotational momentum of the remaining portion of the fluid into axial movement with the static diffuser assembly is performed over a plurality of stages that distribute the remaining portion of the fluid across different radial locations.

13. The method of claim 11 and further comprising:

dividing the remaining portion of the fluid into a plurality of subflows directed into a plurality of stages of the static diffuser assembly.

14. The method of claim 11 and further comprising:

passing the remaining portion of the fluid through a cruciform flow guide at a downstream end of the static diffuser assembly.

15. The method of claim 11, wherein the fluid pressure of the remaining portion of the fluid downstream of the static diffuser assembly is substantially equal at radially inward and radially outward locations.

16. The method of claim 11, wherein the step of separating oil from the fluid within the rotating separator assembly comprises passing the fluid through a rotating metallic foam structure.

17. A gas turbine engine assembly comprising:

a housing;

one or more inlets defined in the housing for accepting a fluidic mixture of oil and air, wherein at least one of the one or more inlets has a generally tangential orientation to impart circumferential rotational motion to the fluidic mixture of oil and air entering the housing;

a rotatable oil separator having one or more fluid inlets and arranged about an axis of rotation to accept the fluidic mixture of oil and air;

a breather outlet defined in the housing and positioned coaxially with the rotatable oil separator, wherein the breather outlet accepts fluidic output from the rotatable oil separator after oil has been removed from the fluidic mixture; and a static diffuser supported by the housing in a cantilevered configuration and in fluid communication with both the breather outlet and the rotatable oil separator, the static diffuser comprising:

a substantially cylindrical support tube;

a plurality of diffuser stage plates supported by the support tube; and a plurality of flow straightening passages defined in each diffuser stage plate, wherein each flow straightening passage is configured to redirect fluid flow from a generally radial direction to a generally axial direction to reduce vortex flows.

18. The assembly of claim 17, wherein the flow straightening passages each define an inlet at a circumference of the respective diffuser stage plate and an outlet at a radially inward portion of the respective diffuser stage plate, wherein at least one of the diffuser stage plates defines a plurality of pass-through openings aligned with the outlets of the flow straightening passages of an adjacent one of the diffuser stage plates located immediately upstream, and wherein the outlets of each respective diffuser stage plate are at a different radial location.

19. The assembly of claim 17, wherein the static diffuser further comprises:

a cruciform flow guide at a downstream end of the support tube.

20. The assembly of claim 17 and further comprising:

a separator shaft secured to the rotatable separator, wherein the support tube is positioned coaxially with and at least partially within the separator shaft, the separator shaft including one or more radial openings.

* * * * *